US005181754A

United States Patent [19]

Shibata

[11] Patent Number: 5,181,754

[45] Date of Patent: Jan. 26, 1993

[54] VEHICULAR DOOR LOCK DEVICE

[75] Inventor: Thoru Shibata, Utsunomiya, Japan

[73] Assignee: Mitsui Kinzoku Kogyo Kabushiki Kaisha, Tokyo, Japan

[21] Appl. No.: 732,528

[22] Filed: Jul. 19, 1991

[30] Foreign Application Priority Data

Jul. 20, 1990 [JP] Japan ..... 2-192291
Dec. 12, 1990 [JP] Japan ..... 2-410277

[51] Int. Cl.[5] ..... E05C 3/26

[52] U.S. Cl. ..... 292/216; 292/336.3; 292/DIG. 38; 292/DIG. 26

[58] Field of Search ..... 292/216, 280, 337, 336.3, 292/DIG. 26, DIG. 38

[56] References Cited

U.S. PATENT DOCUMENTS

| | | | |
|---|---|---|---|
| 3,858,919 | 1/1975 | Kleefeld et al. | 292/DIG. 26 X |
| 4,073,519 | 2/1978 | Kuroyu et al. | 292/216 |
| 4,364,590 | 12/1982 | Hamada | 292/216 X |
| 5,046,341 | 9/1991 | Ogino et al. | 292/216 X |
| 5,064,229 | 11/1991 | Hamada et al. | 292/216 |

*Primary Examiner*—Richard E. Moore
*Attorney, Agent, or Firm*—Browdy and Neimark

[57] ABSTRACT

A vehicular door lock device comprises a body having on its front side a guide groove for receiving a striker and on its rear side a raised portion for defining the guide groove, a latch, a ratchet engaged with the latch, outer and inner levers connected to outer and inner handles of the door respectively, a locking lever connected to a key, an outer link placed between the locking lever and the open lever and changed to an unlocked position and a locked position when the locking lever rotates, an inner link conencted to the inner lever so as to release the ratchet from the latch when the inner lever rotates irrespective of a locked condition. The outer link and the locking lever are connected through an intermediate link. A back plate is fixed to the rear side of the body. Between the rear side of the body and the back plate, there are formed of a first space for accommodating the outer and inner levers placed above the raised portion, a second space for accommodating thelocking lever placed below the raised portion, and a third space for accommodating the outer and inner links placed by the raised portion due to the height of the raised portion. The inner link has an engagement portion to displace the locking lever to an unlocked position when the inner link descends.

5 Claims, 9 Drawing Sheets

(PRIOR ART)

VEHICULAR DOOR LOCK DEVICE

BACKGROUND OF THE INVENTION

1. Field of the Invention

The present invention relates to a vehicular door lock device.

2. Prior art

According to the conventional and well-known vehicular door lock device disclosed in Japanese Patent Application Laid-open Sho 50-111724, the mechanism has as shown in FIG. 12 a body A provided with a raised portion B defining a guide groove which a striker fixed to a vehicle body or chassis, a latch journalled rotatably to the body A so as to engage with the striker, a ratchet for holding an engagement between the latch and the striker, an open lever C to be connected to an outer portion of the door and an inner handle, a locking lever adapted to be displaced between its locked position and an unlocked position by means of a key cylinder of the door, and an operative link F adapted to change its position from the unlocked position at which position the link is engaged with a projection E of the ratchet and to the locked position where the link cannot engage with the projection E when the lock lever D displaces, and the operative link F is placed between the locking lever D and the open lever C.

It is noted that the operative link F extends from the opening lever C to the locking lever D through the raised portion B, so that the link F and the raised portion B are structurally overlapped, making a problem of an increased thickness of the whole construction of the conventional lock device.

SUMMARY OF THE INVENTION

Consequently, it is a purpose of the present invention to provide a vehicular door lock device provided with an operative link and a raised portion which are not overlapped.

It is another purpose of the present invention to provide a vehicular door lock mechanism, which overcomes the problem of the prior art and in addition has a key-less lock mechanism preventing the key from being closed-in the vehicular room and/or an one-motion door opening mechanism using an inner handle.

DETAILED EXPLANATION OF THE INVENTION

An embodiment of the vehicular door lock device according to the present invention will be explained with reference to the accompanying drawings.

Figure 1:
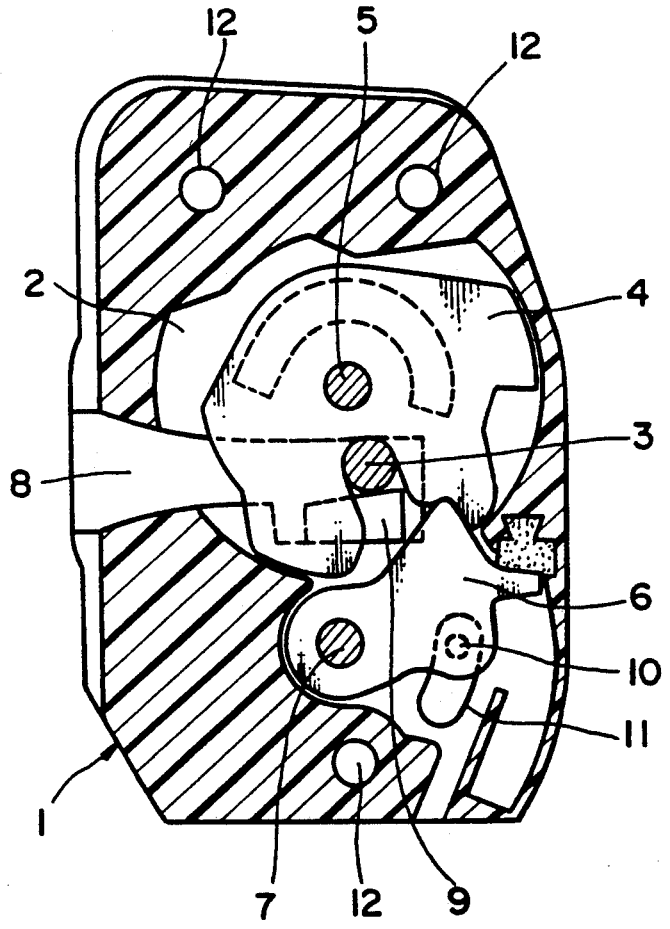
FIG. 1 is a transversal front view of the door lock device according to the present invention.

As shown in FIG. 1 apparently, the synthetic resin made body 1 of the door lock device has a dent 2 formed on an outer surface of the body 1. In the dent 2, there are a latch 4 engaging with a striker 3 fixed to the vehicular body and being rotatably accommodated therein through a shaft 5, and a ratchet 6 for preventing the latch 4 from reversely turning and being rotatably accommodated therein through a shaft 7. To the outer surface of the body 1, a cover plate (not shown) covering the dent 2 is fixed. The striker 3 enters into the guide groove 8. 9 means a wedge. A protrusion 10 formed on the ratchet 6 projects to a rear side of the body 1 through an arc-like hole 11 formed in the body 1. 12 are a plurality of fixing through holes formed on the body 1.

Figure 2:
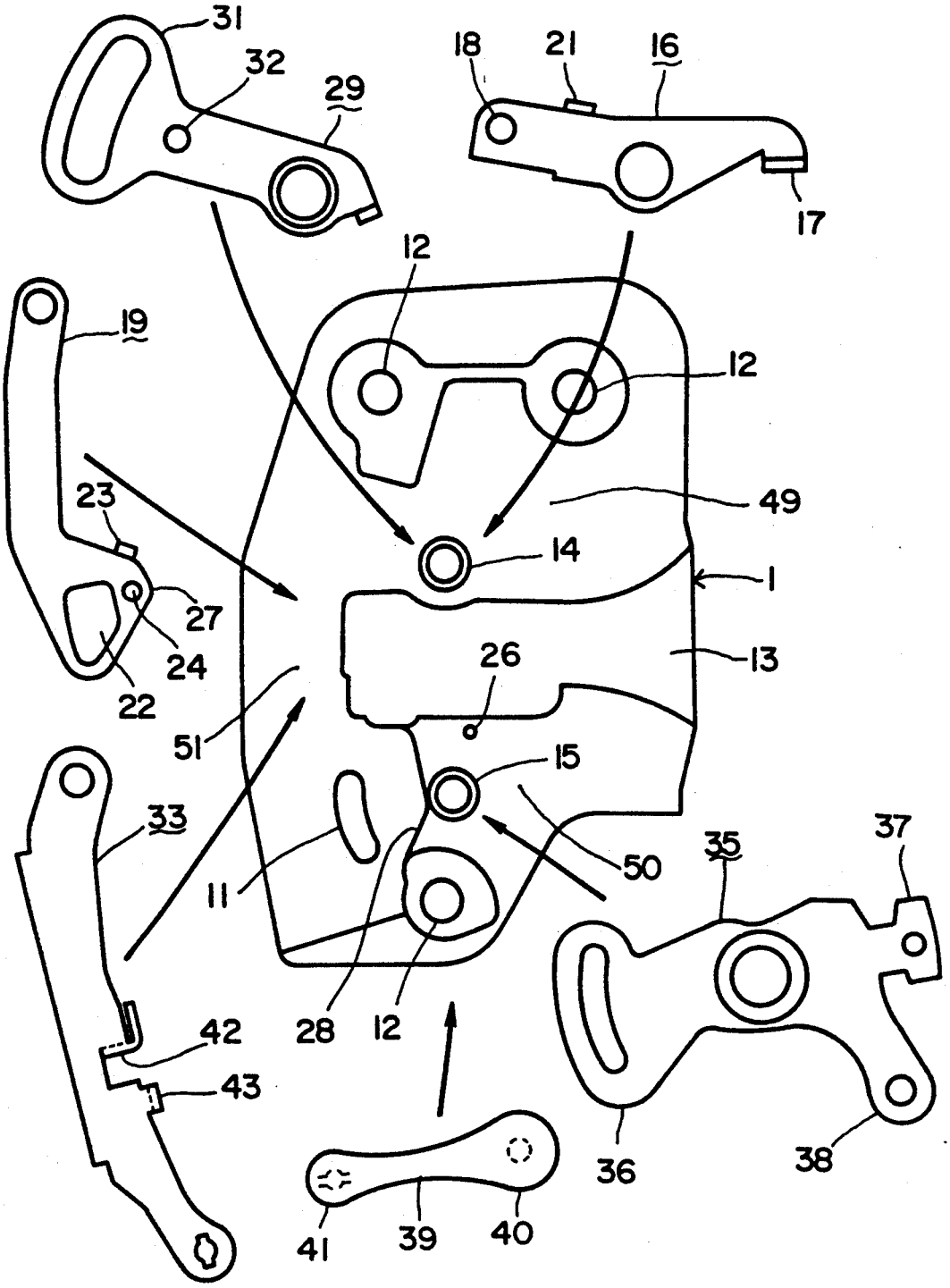
FIG. 2 is an exploded view of the lock device shown in FIG. 1.
Figure 10:
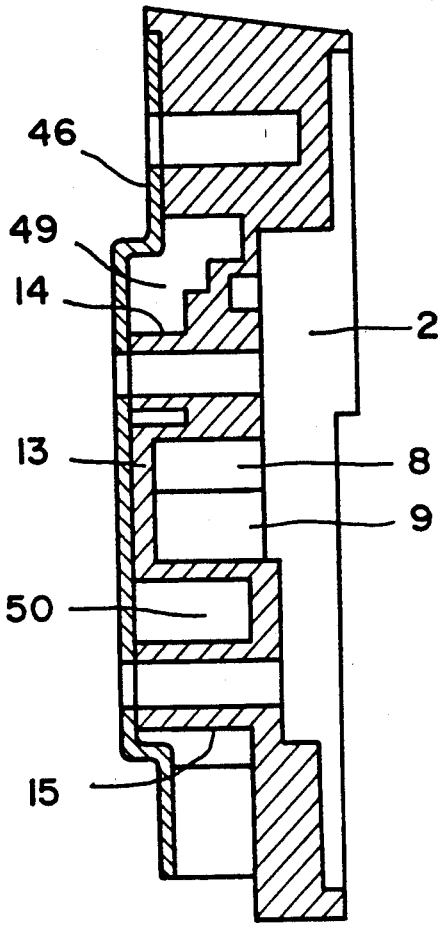
FIG. 10 is a transversal side elevation of the body.
Figure 11:
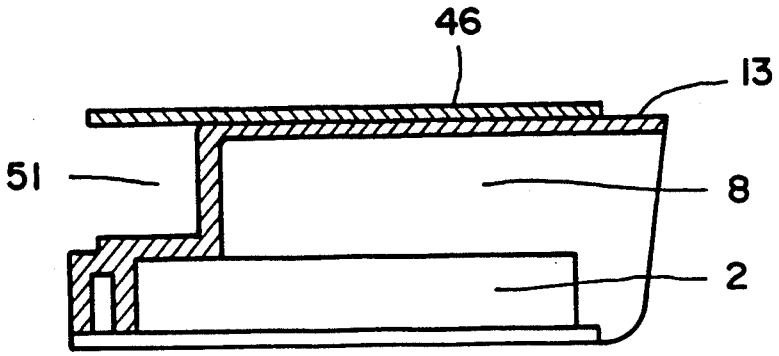
FIG. 11 is a cross-plan view of the body.

On the rear side of the body 1, there is a raised portion 13 being lengthen along a right and left direction. The raised portion 13 is raised from the rear side and integrally formed thereon. The raised portion 13 has a transversal sectional shape of substantial U-shape as shown in FIG. 10. The guide groove 8 is formed on the open side of the raised portion 13. At a position above the raised portion 13 of the body 1, there is a shaft cylinder 14 to which the shaft 5 is journalled as shown in FIG. 2. At another position below the raised portion 13 of the body 1, there is a shaft cylinder 15 to which the shaft 7 is journalled. These shaft cylinders 14 and 15 are integrally formed on the body 1.

The inner lever 16 fits rotatably to the shaft cylinder 14. The inner lever 16 has an engagement piece 17 formed at one end of the lever. The inner handle of the door is indirectly connected or engaged to the engagement piece 17. On another end of the inner lever 16, there is a fixing hole 18 to which hole an upper end of the inner link 19 is engaged through a pin 20. 21 is an engagement projection to be engaged with the outer lever which will be explained later.

Figure 3:
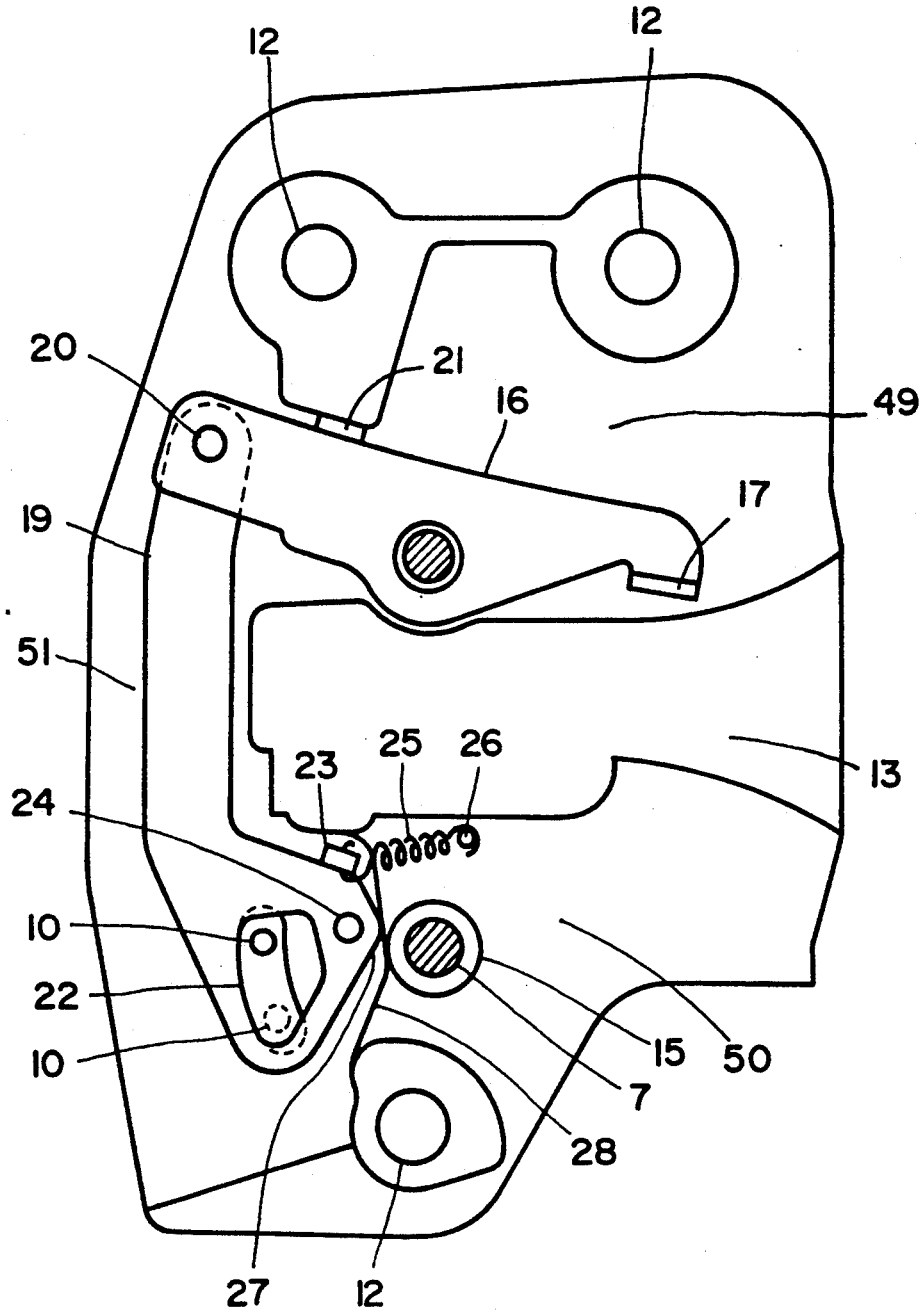
FIG. 3 is a rear view of the door lock device provided with a body, and an inner lever and an inner link, both being attached to the body.

It is apparent from FIG. 3 that the inner link 19 extends downward by an end of the raised portion 13 or bypasses the raised portion 13, and has a lower end portion with a window 22 formed therein. The projection 10 of the ratchet 6 faces to the window 22. The inner link 19 has a protrusion 23 and an engagement portion 24 used to rotate the locking lever which will be explained later in detail, respectively placed near the window 22. One end of the spring 25 is engaged with the protrusion piece 23 and its another end is engaged with the projection 26 of the body 1, in order to pull or rotate the inner link 19 around the pin 20. When the inner link 19 abuts against a stepped portion 28 formed on the body 1 through a side face 27 of the lower end portion of the inner link 19, the link is made stable. The stepped portion 28 extends substantially downward.

As shown in FIG. 3, one position, shown by a solid line, of the projection 10 formed on the ratchet 6 indicates a door-open-one and the other position shown by a dotted line indicates a door-closed-one. When the ratchet 6 is at the door-closed-position and the inner lever 16 rotates, the inner link 19 descends and the projection 10 is pushed down through the window 22 engaged with the projection 10. Consequently, the ratchet 6 is rotated making the door openable. This door-open-operation due to a descending of the inner link 19 can be attained even if the lock device is at its locked condition. This construction is a basis of an one-motion door opening door.

Figure 12:
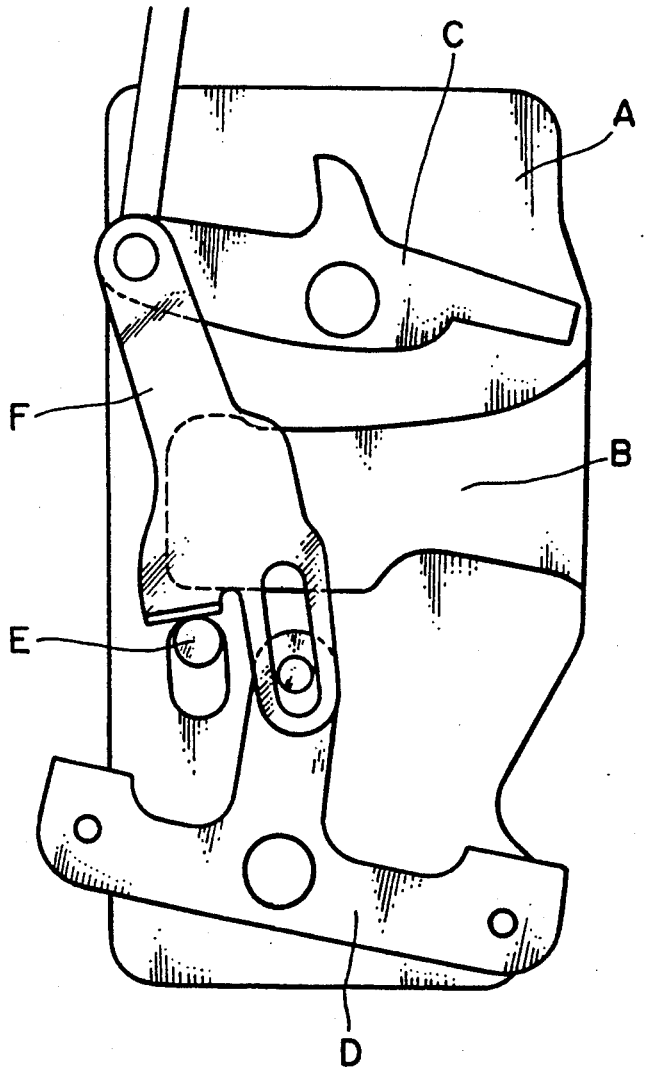
FIG. 12 is a vehicular door lock device according to the prior art.

The outer lever 29 is overlapped with the inner lever 16 and fits onto the shaft cylinder 14 so as to rotate. The outer lever 29 and the inner lever 16 correspond to an opening lever C of the conventional lock device shown in FIG. 12. That is, according to the present invention, the opening lever C is divided into two levers 16 and 19.

It is noted that the outer lever 29 is urged to rotate clockwise through the spring 30, and similarly the inner lever 16 is pushed to rotate clockwise through an engagement of the outer lever 29 and an engagement projection 21. An arc-like opening 31 is formed on the end of the outer lever 29 and a rod (not shown) connected to the outer handle of the vehicular door is joined to the arc-like opening 31. An upper end of an outer link 33 loosely fits in or is journalled with play to a fixing hole 32 of the outer lever 29 through a pin 34. The outer link 33 is placed on the rear side of the inner link 19 so as to be overlapped with the inner link 19. The outer link 33 corresponds to the operative link F in the conventional lock device shown in FIG. 12.

A boss 44 of the locking lever 35 displaceable between the door locked position (FIG. 5) and the door unlocked position (FIG. 4) rotatably fits on the shaft cylinder 15. The locking lever 35 has three legs. Of these legs, a key cylinder side of the door is connected to a first leg 36, a sill knob side of the door is connected to a second leg 37, and one end 40 of an intermediate link 39 is rotatably journalled with a third leg 38. The locking lever 35 is adapted to be held at one of the door locked position and the door unlocked position by means of an over-centering spring (not shown). A lower end of the outer link 33 is connected to another end 41 of the intermediate link 39.

Figure 4:
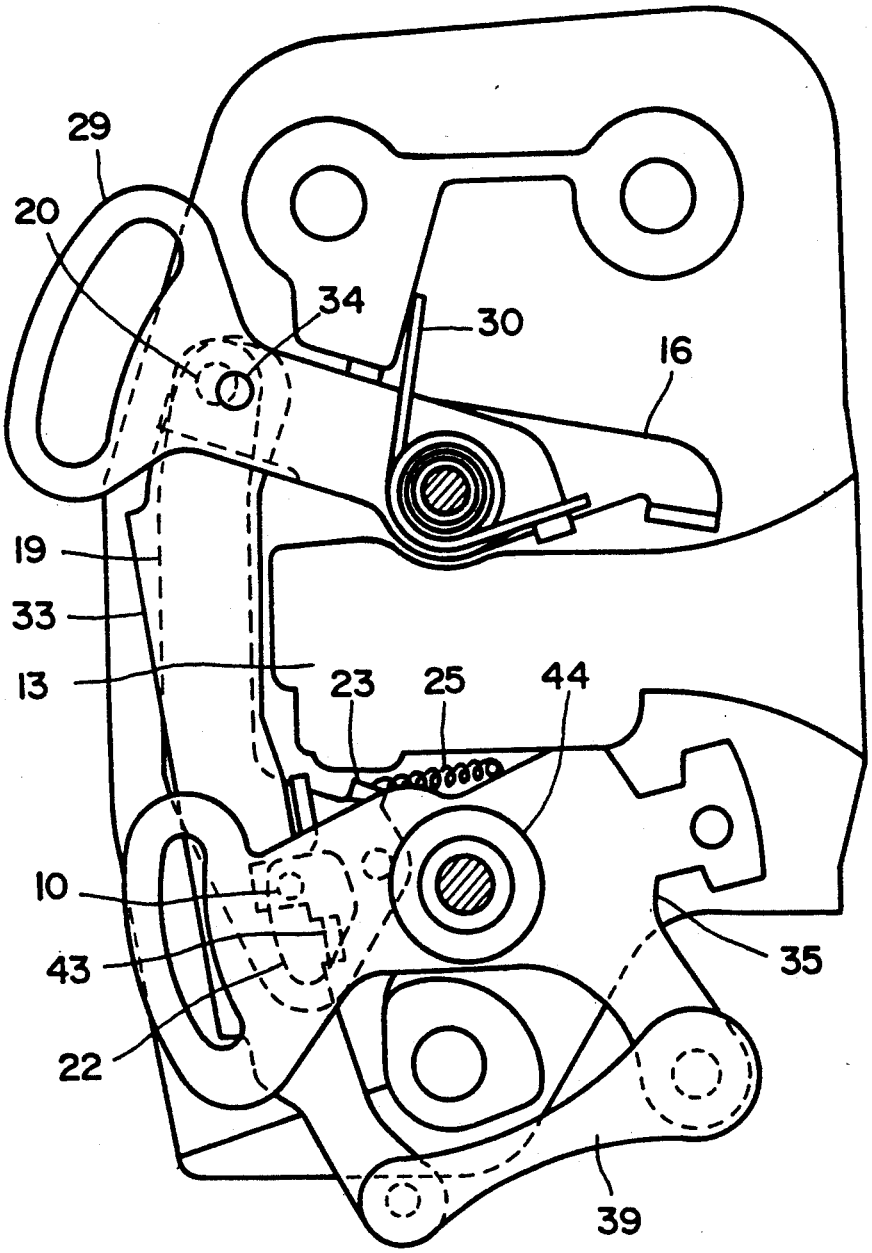
FIG. 4 is a rear view of the door lock device without a back plate removed and in its unlocked condition.
Figure 5:
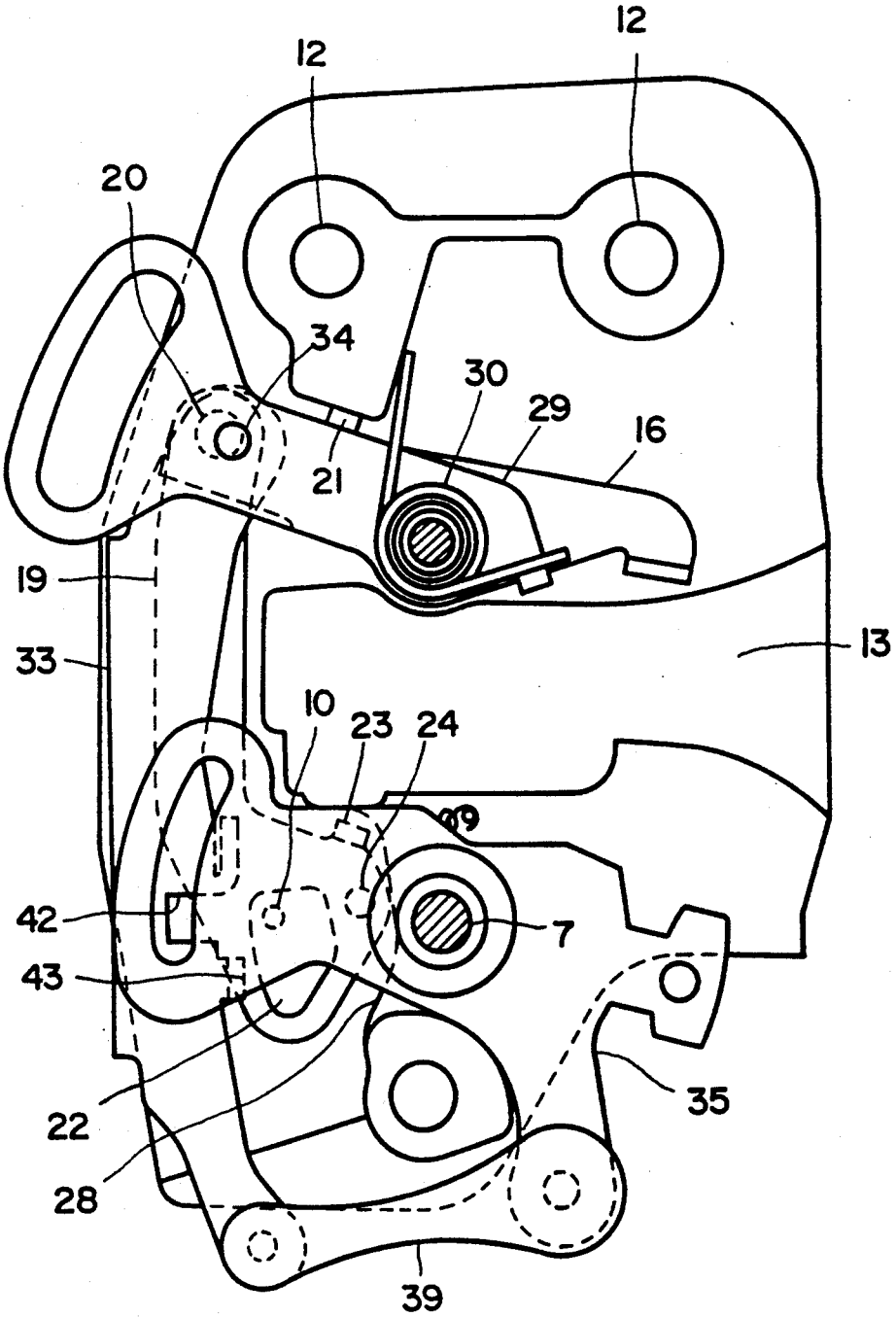
FIG. 5 is a rear view of the door lock device without a back plate removed and in its locked condition.
Figure 6:
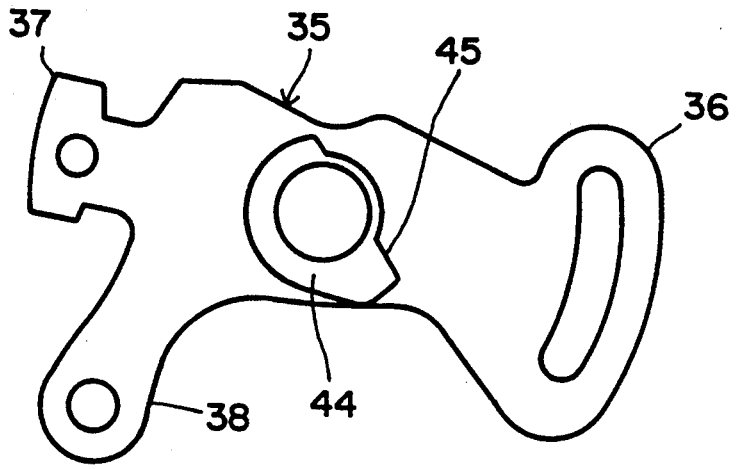
FIG. 6 is a front view of the locking lever.

When the locking lever 35 rotates, the outer link 33 displaces its position around the pin 34 and moves to the locked position of FIG. 5 or the unlocked position of FIG. 4. The outer link 33 has an abutment portion 42 formed thereon, which portion 42 faces or confronts with the projection 10 of the ratchet, 6 when it is at the door unlocked position, and away from the projection 10 when at the door locked position. Accordingly, when the outer handle makes the outer lever 29 rotate in order to descend the outer link 33, the abutment portion 42 of the outer link 33 pushes the projection 10, so that the ratchet 6 rotates enabling the door to open.

As shown in FIG. 4, when the ratchet 6 is at its door-closed position, the locking lever 35 rotates to the locked position and it is possible for the outer link 33 to move to the locked position. On the contrary, when the ratchet 6 is at its door-open position, a projection 43, formed on the outer link 33 in order to prevent the key from being closed-in the vehicular room, descends and abuts against the projection 10 through the abutment portion 42. Consequently, it is impossible that the locking lever 35 and the outer link 33 to move to the locked position.

In order to change the position of the locking lever 35 to the locked one when the door is at openable condition, the inner lever 16 or the outer lever 29 are operated in order to descend the outer link 33 (FIG. 9) and rotate the locking lever 35 together with coming off the projection 43 for preventing the key from being closed-in by the projection 10. In this situation, closing the door enables to open the door when it is under the locked condition. In other words, by adding operations of the inner lever 16 or the outer lever 29 to the interchanging operation to the locked condition under a door openable situation, it is confirmed that a prevention of keys from being closed-in.

Figure 7:
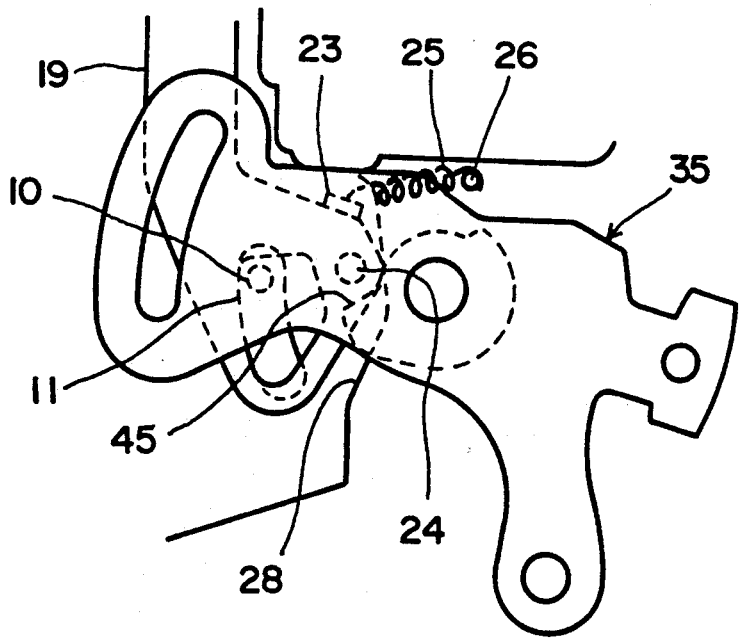
FIG. 7 is an explanation of the locking lever and the inner link.
Figure 8:
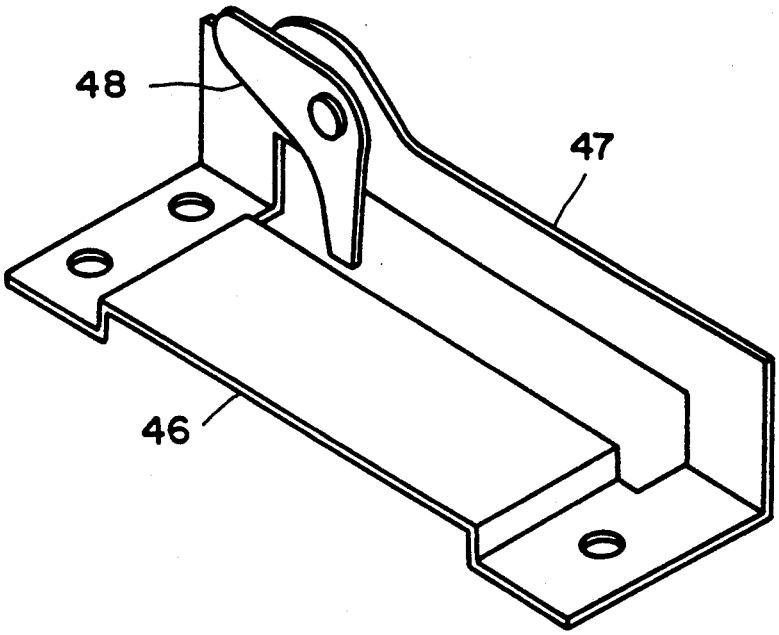
FIG. 8 is a perspective view of the back plate.

The boss 44 of the locking lever 35 has a cam surface 45 formed thereon so as to be engaged with an engagement portion 24 of the inner link 19. When the inner link 19 descends, the engagement portion 24 pushes the cam surface 45 in order to change the position of the locking lever 35 to its unlocked position (FIG. 7). Due to such construction, it is possible to simultaneously carry out a door open operation and a returning of the locking lever 35 to its unlocked position after the inner lever 16 is operated to open the door during a door locked condition.

A back plate 46 is fixed to the rear face of the body 1. An intermediate lever 48 for connecting relationally the inner lever 16 to the inner handle of the door is journalled to a rising wall 47 of the back plate 46. After the back plate 46 is attached to the rear face of the body 1, a space 49 enclosed by the body 1 and the back plate 46 is formed above the raised portion 13, a space 50 enclosed by the body 1 and the back plate 46 is formed below the raised portion 13, and a space 51 enclosed by the body 1 and the back plate 46 is formed by the raised portion 13. The outer link 29 and the inner link 19 are placed in the space 51.

OPERATION

When the door is closed, the striker 3 fixed to the vehicular body enters the guide groove 8 and engages with the latch 4. When the latch 4 rotates to the locked position, the ratchet 6 engages with the latch 4 in order to prevent the latch 4 from reverse-rotating and close the door (FIGS. 1 and 4).

When the locking lever 35 rotates clockwise by the key or sill knob under the condition shown in FIG. 4, the intermediate link 39 moves to the left on the drawing, the outer link 33 rotate clockwise around the pin 34 attaining the locked condition shown in FIG. 5. Consequently, even a descendent motion of the outer link 33 cannot make the engagement portion 42 engage with the projection 10, so that the outer link 33 runs idle and the latchet 6 doesn't move, resulting in not-opening of the door.

When it is under the locked condition, and the inner handle of the door is operated to rotate the inner lever 16, the inner link 19 moves downward along the stepped portion 28, the engagement portion 24 abuts against the cam surface 45 of the locking lever 35 to change the position of the locking lever 35 to the unlocked position, and the window 22 makes the projection 10 move down rotating the ratchet 6. As a result, one operation can obtain a returning to the unlocked condition and a release of the ratchet resulting in opening the door. It is called one-motion door-open mechanism.

Figure 9:
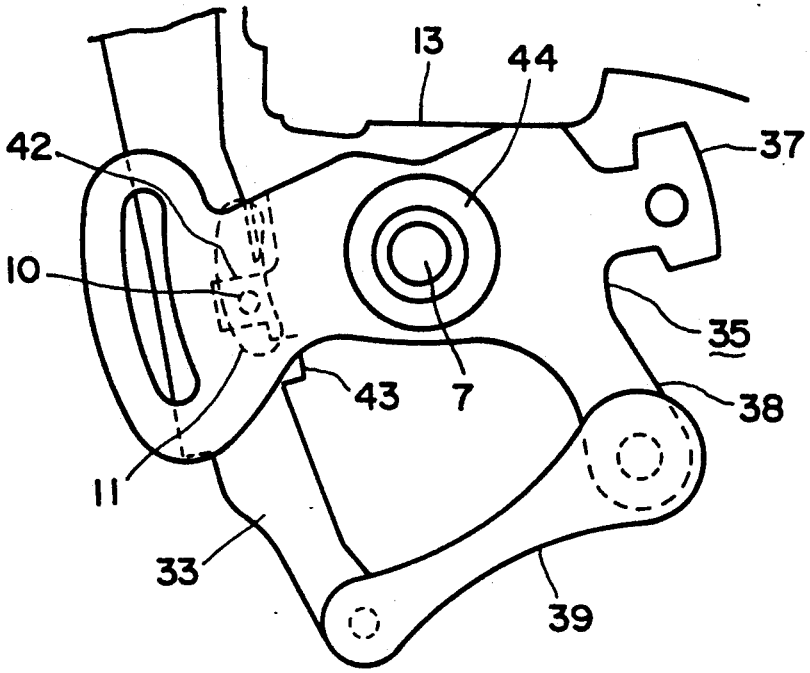
FIG. 9 is an explanation of an operation of the keyless lock mechanism.

Further, the projection 10 of the latchet 6 is placed at a lower position as shown in FIG. 3 under the door open condition, resulting in an engagement of the projection 43 of the outer link 33 with the projection 10 of the latchet 6. Consequently, when you try to change the position of the locking lever 35 to the locked one, it is not changed to the locked position. In order to solve the condition, the inner lever 16 or the outer lever 29 is operated to move downward the outer link 33 and come off the projection 43 from the projection 10 (FIG. 9). When the locking lever 35 rotates to the locked position under the situation above and the door is closed, it is possible to open the door under the locked condition. It is called a key-less locking mechanism.

According to the key-less locking mechanism, when the inner lever 16 is operated and the locking lever 35 is rotated, the engagement portion 24 of the descending inner link 19 engages with the cam surface 45 of the locking lever 35, then the inner link 19 rotates evadingly around the pin 20 against an elasticity of the spring 25. As a result, the locking lever 35 is prevented from rotating.

Now, the outer link 29 and the inner link 19 are placed in the space 51 formed between the rear face of the body 1 and the back plate 46, so that they are not overlapped with the raised portion 13 obtaining a thin lock device of the present invention.

Further, because levers operatively necessary to the key-less mechanism and the one-motion lock relief mechanism are installed at a side of the body 1, the back plate 46 has few parts to be attached thereto resulting in a vehicular lock device of an excellent assembling operation and a small size.

What is claimed is:

1. A vehicular door lock device comprising:

a lock body provided at its front side with a guide groove into which a striker fixed to the vehicular body enters and at its rear side with a raised portion for defining said guide groove;

a latch journalled rotatably with the lock body and engaged with the striker;

a ratchet for holding an engagement of said latch with said striker;

an opening lever rotatably journalled with the rear side of the lock body at a position above the raised portion and connected to an outer handle of the door;

locking lever means rotatably journalled to the rear side of the lock body at a position below the raised portion for locking and unlocking the door with a key;

operative link means placed between said locking lever means and said opening lever for unlocking the door when it engages said ratchet and being disengaged from said ratchet when said locking lever means is rotated to lock the door; and wherein said operative link means and said locking lever means are connected by an intermediate link, and said operative link means is placed so as to not overlap with the raised portion.

2. The vehicular door lock device according to claim 1, wherein said operative link means has a projection for preventing it from being rotary displaced to its locked position when the door is under the open condition and said operative link is placed at its rised position.

3. The vehicular door lock device according to claim 1, wherein a rear side of the lock body has a metal back plate fixed thereto, and there are a first space placed above the raised portion, a second space placed below the raised portion, and a third space placed by the raised portion, respectively between the rear side of the lock body and the back plate due to a height of the raised portion, wherein said opening lever is accommodated in the first space, said locking lever means is accommodated in the second space, and said operative link means is accommodated in the third space.

4. The vehicular door lock device according to claim 1, wherein said opening lever comprises an outer lever to which an outer handle of the door and said operative link are connected, and an inner lever to which an inner handle of the door is connected, said lock device has an inner link connected to said inner lever so as to release the ratchet from the latch when the inner lever rotates irrespective of a locked condition of said lock device, said inner link being placed so as to overlap with said operative link means.

5. The vehicular door lock device according to claim 4, wherein said inner link has an engagement portion for abutment against said locking lever means to displace said locking lever means to an unlocked position when the inner link descends.

* * * * *